US006198266B1

(12) United States Patent
Mercer

(10) Patent No.: US 6,198,266 B1
(45) Date of Patent: Mar. 6, 2001

(54) LOW DROPOUT VOLTAGE REFERENCE

(75) Inventor: Mark J. Mercer, Tuscon, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/416,898

(22) Filed: Oct. 13, 1999

(51) Int. Cl.[7] ..... G05F 3/16; G05F 1/565; G05F 1/40

(52) U.S. Cl. ..... 323/316; 323/275; 323/280

(58) Field of Search ..... 323/274, 275, 323/280, 281, 315, 316

(56) References Cited

U.S. PATENT DOCUMENTS

| | | | | |
|---|---|---|---|---|
| 3,887,863 | | 6/1975 | Brokaw | 323/19 |
| 4,190,805 | | 2/1980 | Bingham | 330/9 |
| 4,250,445 | | 2/1981 | Brokaw | 323/313 |
| 4,543,522 | | 9/1985 | Morean | 323/303 |
| 4,603,291 | | 7/1986 | Nelson | 323/315 |
| 4,613,809 | | 9/1986 | Skovmand | 323/268 |
| 4,779,037 | * | 10/1988 | LoCascio | 323/275 |
| 4,792,747 | | 12/1988 | Schroeder | 323/303 |
| 4,808,908 | | 2/1989 | Lewis et al. | 323/313 |
| 4,902,959 | | 2/1990 | Brokaw | 323/314 |
| 4,906,913 | | 3/1990 | Stanojevic | 323/303 |
| 4,926,109 | * | 5/1990 | Koterasawa | 323/274 |
| 4,928,056 | | 5/1990 | Pease | 323/314 |
| 5,126,653 | | 6/1992 | Ganesan et al. | 323/313 |
| 5,168,209 | | 12/1992 | Thiel | 323/313 |
| 5,191,278 | | 3/1993 | Carpenter | 323/275 |
| 5,274,323 | | 12/1993 | Dobkin et al. | 323/280 |
| 5,291,122 | | 3/1994 | Audy | 323/313 |
| 5,325,045 | | 6/1994 | Sundby | 323/313 |
| 5,334,928 | | 8/1994 | Dobkin et al. | 323/280 |
| 5,352,973 | | 10/1994 | Audy | 323/313 |
| 5,391,980 | | 2/1995 | Thiel et al. | 323/314 |
| 5,410,241 | | 4/1995 | Cecil | 323/315 |
| 5,485,109 | | 1/1996 | Dobkin et al. | 327/77 |
| 5,510,697 | | 4/1996 | Dormer | 323/273 |
| 5,519,308 | | 5/1996 | Gilbert | 323/313 |
| 5,552,697 | * | 9/1996 | Chan | 323/282 |
| 5,563,501 | * | 10/1996 | Chan | 323/282 |
| 5,563,504 | | 10/1996 | Gilbert et al. | 323/316 |
| 5,629,609 | | 5/1997 | Nguyen et al. | 323/269 |
| 5,631,598 | | 5/1997 | Miranda et al. | 327/540 |
| 5,672,959 | | 9/1997 | Der | 323/273 |
| 5,675,241 | | 10/1997 | Teggatz et al. | 323/282 |
| 5,677,558 | | 10/1997 | McGlinchey | 257/370 |
| 5,686,821 | | 11/1997 | Brokaw | 323/273 |
| 5,705,919 | * | 1/1998 | Wilcox | 323/282 |

(List continued on next page.)

OTHER PUBLICATIONS

B. Song and P.R. Gray, "A Precision Curvature–Compensated CMOS Bandgap Reference," *JSSC*, pp. 634–643, Dec. 1983.

(List continued on next page.)

*Primary Examiner*—Peter S. Wong
*Assistant Examiner*—Bao Q. Vu
(74) *Attorney, Agent, or Firm*—Beyer Weaver & Thomas, LLP

(57) ABSTRACT

A low dropout voltage reference having three gain stages and two feedback loops, an overall loop and a secondary loop, is disclosed. The overall feedback loop establishes a desired output voltage. The secondary feedback loop provides two benefits: (1) a broadband reduction of the output impedance to ensure stability under various loading conditions and (2) an improvement in power supply rejection. The first benefit ensures that the pole created by the load capacitance and the output impedance of the amplifier doesn't adversely affect the overall loop stability. The second benefit helps improve line regulation. The low dropout voltage reference does not rely on a capacitor connected to the output to properly compensate the overall feedback loop. Therefore, the reference will work properly for a wide range of load capacitance values.

23 Claims, 7 Drawing Sheets

U.S. PATENT DOCUMENTS

| | | | | |
|---|---|---|---|---|
| 5,736,843 | | 4/1998 | Amin | 323/273 |
| 5,781,002 | * | 7/1998 | O'Neill | 323/299 |
| 5,814,979 | | 9/1998 | Grimm | 323/284 |
| 5,864,227 | * | 1/1999 | Borden et al. | 323/299 |
| 5,867,015 | | 2/1999 | Corsi et al. | 323/316 |
| 6,091,235 | * | 7/2000 | O'Neill | 323/299 |
| 6,097,178 | * | 8/2000 | Owen et al. | 323/273 |
| 6,111,439 | * | 8/2000 | Nelson et al . | 327/110 |

OTHER PUBLICATIONS

Holman, Timothy, "A New Temperature Compensation Technique for Bandgap Voltage References," *ISCAS,* pp. 385–388, 1996. No Month.

Rincon–Mora, G.A. and Allen, P.E., "A1.1V Current_Mode and Piecewise–Linear Curvature–Corrected Bandgap Reference," *JSSC,* pp. 1551–1554. No Date.

Gray, P.R. and Meyer, R.G., "Band–Gap Referenced Biasing Circuits,"πsection A4.3.2 in Analysis and Design of Analog Integrated Circuits, 3$^{rd}$ ed. No Date.

Sze, S.M., "Carrier Transport Phenomena," section 1.5 in Physics of Semiconductor Devices, 2$^{nd}$ ed. (Wiley, 1981). No Month.

Annema, Anne–Johan, "Low–Power Bandgap References Featuring DTMOST's," *IEEE Journal of Solid–State Circuits,* vol. 34, No. 7, pp. 949–955, Jul. 1999.

Banba, Hironori et al., "A CMOS Bandgap Reference Circuit with Sub–1–V Operation," *IEEE Journal of Solid–State Circuits,* vol. 34, No. 5, pp. 670–673, May 1999.

Sudha, Maramreddy and Holman, W. Timothy, "A Low Noise Sub–Bandgap Voltage Reference," *IEEE,* pp. 193–196, 1997. No Month.

Pease, Robert A., "The Design of Band–Gap Reference Circuits: Trials and Tribulations," *IEEE 1990 Bipolar Circuits and Technology Meeting 903,* pp. 214–218. No Date.

Lin, S.L. and C.A.T. Salama, "Regular Correspondence," *IEEE Journal of Solid–State Circuits,* vol. SC–20, No. 6, pp. 1283–1285, Dec. 1985.

Michejda, John and Kim, Suk. K., "A Precision CMOS Bandgap Reference," *IEEE Journal of Solid–State Circuits,* vol. SC–19, No. 6, pp. 1014–1021, Dec. 1984.

Palmer, Carl R. and Dobkin, Robert C., "A Curvature Corrected Micropower Voltage Reference," *Session VI: Data Acquisition Circuits, ISSCC 81,* pp. 58–59, Feb. 18, 1981.

Frederiksen, Thomas M., "Intuitive IC OP Amps," From-BAsics to Useful Applications, *National's Semiconductor Technology Series,* pp. 8–12, 1984. No Month.

"IC Peramplifier Challenges Choppers on Drift," National Semiconductor, Application Notes 79–81, pp. 279–281. No Date.

* cited by examiner

| COMPONENT | VALUES AND UNITS |
|---|---|
| R1 | 122.5 kΩ |
| R2 | 127.5 kΩ |
| R3 | 112.5 kΩ |
| R4 | 75 kΩ |
| R5 | 75 kΩ |
| R6 | 12.8 kΩ |
| R7 | 28.4 kΩ |
| I1 | 2 μA |
| I2 | 1 μA |
| I3 | 2.5 μA |
| I4 | 2.5 μA |
| I5 | 4 μA |
| Q1 | emitter area = 2.6μm x 2.6μm x 2 |
| Q2 | emitter area = 2.6μm x 2.6μm x 2 |
| Q3 | emitter area = 2.6μm x 2.6μm x 8 |
| Q4 | emitter area = 2.6μm x 2.6μm x 8 |
| Q5A | emitter area = 2.6μm x 2.6μm x 2 |
| Q5B | emitter area = 2.6μm x 2.6μm x 2 |
| Q6 | emitter area = 2.6μm x 2.6μm x 5 |
| Q7 | emitter area = 2.6μm x 2.6μm x 44 |
| M1 | conduction factor = 90 μA/V^2, W=5μm, L=20μm |
| M2 | conduction factor = 90 μA/V^2, W=85μm, L=20μm |
| M3 | conduction factor = 30 μA/V^2, W=80μm, L=2μm |
| M4 | conduction factor = 30 μA/V^2, W=80μm, L=2μm |
| M5 | conduction factor = 30 μA/V^2, W=80μm, L=1μm |
| M6 | conduction factor = 30 μA/V^2, W=80μm, L=1μm |
| M7 | conduction factor = 90 μA/V^2, W=40μm, L=1μm |
| M8 | conduction factor = 90 μA/V^2, W=40μm, L=1μm |
| M9 | conduction factor = 90 μA/V^2, W=40μm, L=1μm |
| M10 | conduction factor = 90 μA/V^2, W=40μm, L=1μm |
| M11 | conduction factor = 30 μA/V^2, W=2100μm, L=1μm |

FIG. 2(c)

LOW DROPOUT VOLTAGE REFERENCE

BACKGROUND OF THE INVENTION

The present invention is related to U.S. patent application Ser. No. 09/416,899, entitled "CMOS VOLTAGE REFERENCE WITH A NULLING AMPLIFIER", filed Oct. 13, 1999; U.S. patent application Ser. No. 09/416,896, entitled "SLOPE AND LEVEL TRIM DAC FOR VOLTAGE REFERENCE", filed Oct. 13, 1999; and U.S. patent application Ser. No. 09/416,897, entitled "CMOS VOLTAGE REFERENCE WITH POST ASSEMBLY CURVATURE TRIM", filed Oct. 13, 1999; all applications are commonly assigned to the assignee of the present invention, and the disclosures of which are herein incorporated by reference.

1. Field of the Invention

The present invention relates generally to the field of low dropout references, and more particularly to a low dropout reference amplifier circuit that is stable under various load conditions.

2. Description of the Related Art

FIG. 1(A) is a block diagram of a conventional low dropout (LDO) voltage reference. The stability of this type of LDO reference is highly dependent on the load attached to Vout. This load dependence is due to the high impedance of the drain terminal of the p-channel output pass FET M11 that results in a low frequency pole, which introduces a phase shift in the feedback loop. In addition to the stability problems, the line regulation of the conventional reference is poor due in part to the fact that the drain voltages of the cascode p-channel FETs M5, M6 are not constant under all operating conditions. The drain voltage variance results in a differential error current due to the Early effect and/or unbalanced leakage currents from the drain to well junctions. The differential error current will produce an input referred offset error that is power supply dependent. FIG. 1(B) is a schematic of a typical implementation of the conventional LDO circuit of FIG. 1(A).

A low dropout voltage regulator is disclosed in U.S. Pat. No. 5,672,959, entitled "LOW DROP-OUT VOLTAGE REGULATOR HAVING HIGH RIPPLE REJECTION AND LOW POWER CONSUMPTION." The disclosed circuit relies on an external load capacitance to stabilize one of the two feedback loops. This has a similar disadvantage in that the circuit performance is dependent upon the load.

In view of the foregoing, it would be desirable to have a low dropout voltage reference that is stable under various loading conditions and has improved power supply rejection.

SUMMARY OF THE INVENTION

The present invention is a low dropout voltage reference having three gain stages and two feedback loops, an overall loop and a secondary loop. The overall feedback loop establishes a desired output voltage. The secondary feedback loop provides two benefits: (1) a broadband reduction of the output impedance to ensure stability under various loading conditions and (2) an improvement in power supply rejection. The first benefit ensures that the pole created by the load capacitance and the output impedance of the amplifier doesn't adversely affect the overall loop stability. The second benefit helps improve line regulation.

The low dropout voltage reference does not rely on a capacitor connected to the output to properly compensate the overall feedback loop. Therefore, the reference will work properly for a wide range of load capacitance values. Also, the present invention may be manufactured in CMOS, reducing the manufacturing costs associated with bipolar designs.

The present invention incorporates a band-gap core to provide temperature compensation, and in one embodiment uses a differential input stage, an Output Transconductance Amplifier (OTA) and an output MOSFET. Also, a unique compensation scheme for the overall feedback loop is disclosed.

BRIEF DESCRIPTION OF THE DRAWINGS

The present invention will be readily understood by the following detailed description in conjunction with the accompanying drawings, wherein like reference numerals designate like structural elements, and in which:

FIG. 2(C) is a table of component values for the components in FIG. 2(B);

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide a low dropout reference amplifier circuit that is stable under various load conditions.

Figure 2A:
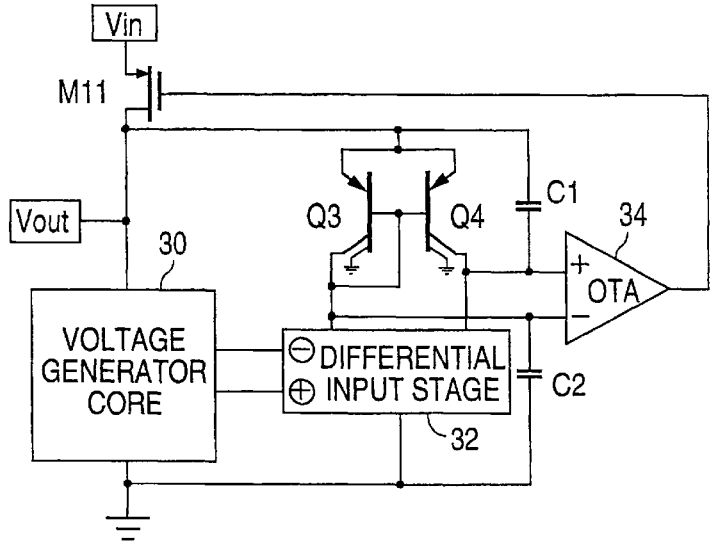
FIG. 2(A) is a block diagram of a low dropout reference according to the present invention.

A block diagram of an embodiment of the present invention is shown in FIG. 2(A). In general, the present invention is a low dropout voltage amplifier with two feedback loops, an overall loop (through the differential input stage 32, differential amplifier 34, to the output FET M11) and a secondary loop (Vout, through the current mirror of Q3, Q4 to the differential inputs of the amplifier 34, through the amplifier 34, to the controlling terminal of the output FET M11, and then through the output FET M11 and back to the output). The overall feedback loop establishes a desired output voltage. The secondary feedback loop provides two benefits: (1) a broadband reduction of the output impedance to ensure stability under various loading conditions and (2) an improvement in power supply rejection.

An LDO amplifier according to the present invention consists of three gain stages, a differential input stage 32, a second gain stage 34, and a PMOS FET M11 output device. The LDO amplifier has a secondary feedback loop where the forward propagating signal passes through the second gain stage 34, through the PMOS output M11 and is fed back to the second gain stage 34 through the current mirror Q3, Q4. This internal secondary feedback loop provides two benefits: (1) the open loop output impedance of the LDO amplifier is lowered by the loop gain of the internal feedback loop and (2) the voltages at the output terminals of the current mirror Q3, Q4 are forced to be essentially equal. The first benefit ensures that the pole created by the load capacitance and the output impedance of the amplifier doesn't adversely affect the overall loop stability. The second benefit helps improve line regulation.

Figure 1A:
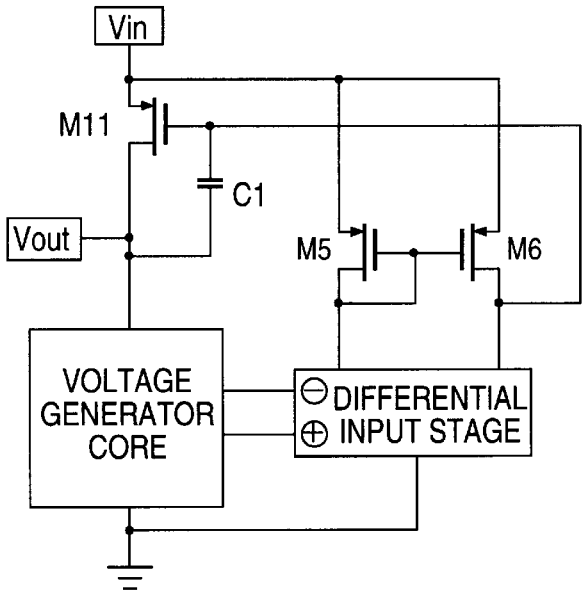
FIG. 1(a) (PRIOR ART)
FIG. 1(A) is a block diagram of a prior art low dropout reference.
Figure 2B:
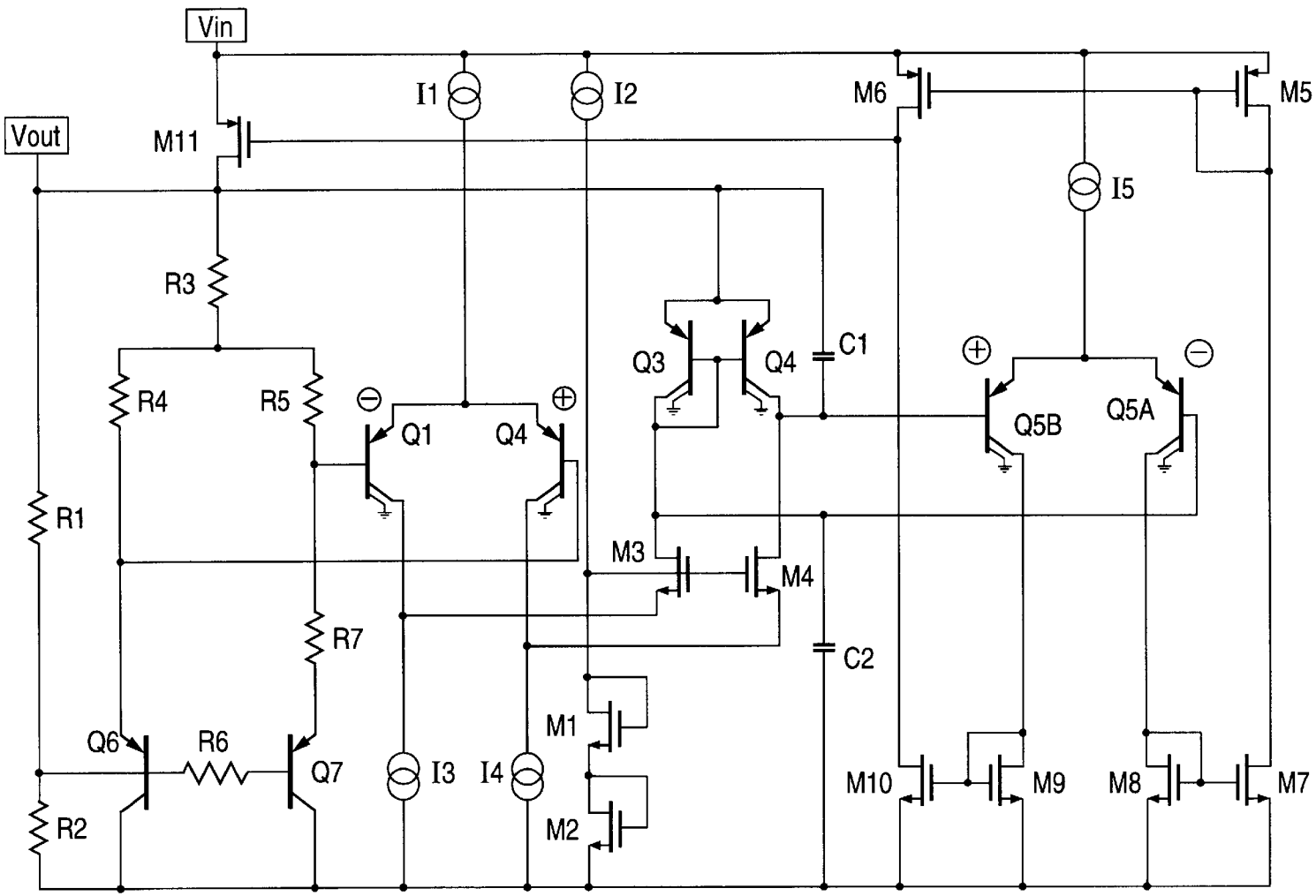
FIG. 2(B) is a schematic of an embodiment of the present invention.

The effect of the overall feedback loop in the present invention is the same as for the basic topology of FIG. 1(A). The action of the overall feedback causes the voltage between the inputs of the differential input stage 32 to be essentially equal to zero. The expression for the output voltage is:

$$Vout \approx (((kT/q)*ln(A7/A6)*(R4+2*R3)/R7))+Vbe6)*(1+R2/R1)$$

where kT/q is the thermal voltage and A7/A6 is the ratio of the emitter areas of Q7 and Q6 (FIG. 2(B)), as is well known to those skilled in the art.

The signal in the secondary feedback loop propagates from the output (Vout in FIG. 2(A)), through the current mirror of Q3, Q4 to the differential input of the Output Transconductance Amplifier (OTA) 34. In the present embodiment, this "second gain stage" amplifier is shown as an OTA. It could, however, be any differential input amplifier, such as an operational amplifier (op-amp), which has the desired common mode input range for a desired application. The signal then travels through the OTA 34 and is then applied to the controlling terminal of the output FET M11. The signal then passes through the output FET M11 and back to the output, thus completing the loop. The signal receives gain as it passes through Q4, the OTA 34 and the output FET M11. The loop gain of the feedback signal is equal to the gain from each of these stages times the feedback factor which is a function of the impedance seen looking into the emitters of Q3 and Q4 and into the drain of M11 (plus the capacitances C1 and C2).

The secondary feedback loop is a type known by those skilled in the art as a shunt sense. It is well known to those skilled in the art that a shunt sense feedback decreases the effective impedance seen at the output by a factor equal to the loop gain. The result of this is that the output impedance of the present low dropout voltage reference is small for frequencies up to the point where the loop gain rolls off to a value of one (or 0 dB). This means that a load capacitor on the output will not degrade the stability of the overall feedback loop.

The second effect of the secondary feedback loop is that the bias conditions for the two transistors in the current mirror Q3, Q4 are held constant even if the voltage at the input (Vin) varies (because it is connected to the output rather than the input). In other words, the voltage at the collector of Q4 is controlled to be substantially equal to the voltage at the collector of Q3. Hence, the current mirror in the disclosed invention does not produce an error signal that is dependent on the input voltage (Vin), as that in the basic topology.

Figure 3:
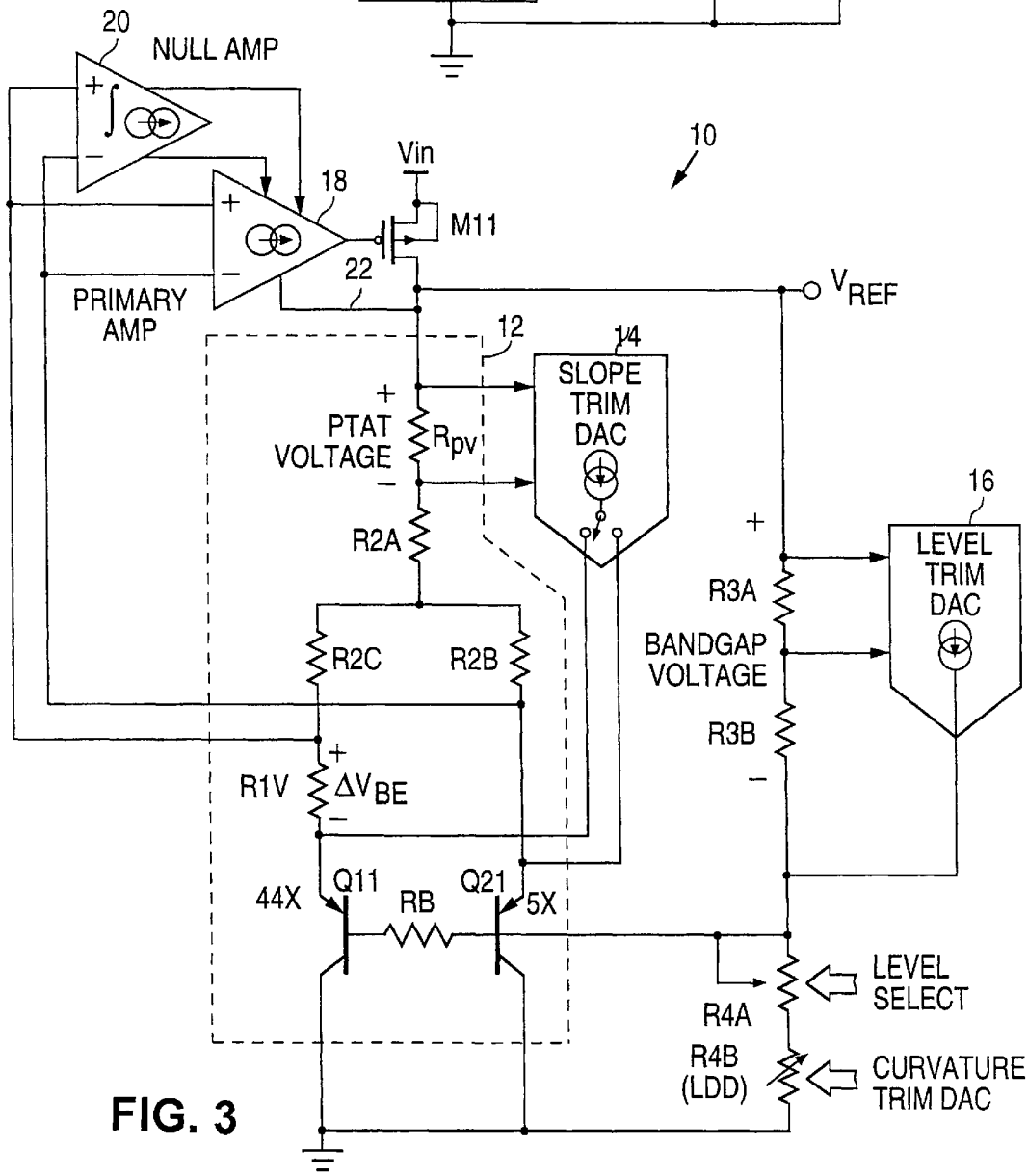
FIG. 3 is a block diagram of a CMOS voltage reference, incorporating the present invention into a circuit having slope, level and curvature correction and offset nullification.

The voltage generator core 30 may be constructed as a Brokaw band-gap core, as is well known to those of skill in art, and disclosed in U.S. Pat. No. 3,887,863. A band-gap core 12 is shown in FIG. 3. A band-gap core comprises a pair of bipolar transistors Q11, Q21 which generate a voltage proportional to absolute temperature (PTAT). A network of resistors connected to these transistors Q11,Q21 are arranged to multiply the PTAT voltage and add it to the base-emitter of one of the transistors so that the total voltage is constant over temperature. The band-gap core 12 thus provides a temperature compensated reference, allowing the present invention to operate over a wide temperature range.

The compensation of the overall feedback loop is achieved with C1 and C2. C2 creates a left half plane pole and zero in the expression for the small signal forward gain. C1 adds another pole to the expression and shifts the location of the zero. Since the dynamic emitter resistance of Q3 is equal to that of Q4 (re3=re4), then pole-zero cancellation is achieved in the gain expression when C1 is set equal to C2. Therefore, the gain stage of the reference (which consists of everything except the voltage generator core) behaves like an ideal integrator with a bandwidth of 1/(C2*re2), where re2 is the incremental emitter resistance of Q2 (re2=re1).

The compensation of the secondary feedback loop is determined by the gate capacitance of the output FET M11, and the output impedance of the OTA 34, ro5. If ro5 is made to be small, then the bandwidth of the secondary feedback loop is much greater than the bandwidth of the overall feedback loop, so the stability of the overall feedback loop is not diminished.

Thus, the present invention does not rely on a capacitor connected to the output to properly compensate the overall feedback loop. Therefore, the reference will work properly for a wide range of load capacitance values.

FIG. 2 (B) shows a simplified circuit diagram of the disclosed invention. Table 2(C) shows typical component values for the components of FIG. 2(B) suitable for use with the present invention. Note that the component values are provided for purposes of illustration and that common parts and their equivalents may be substituted without departing from the scope of the present invention.

Figure 1B:
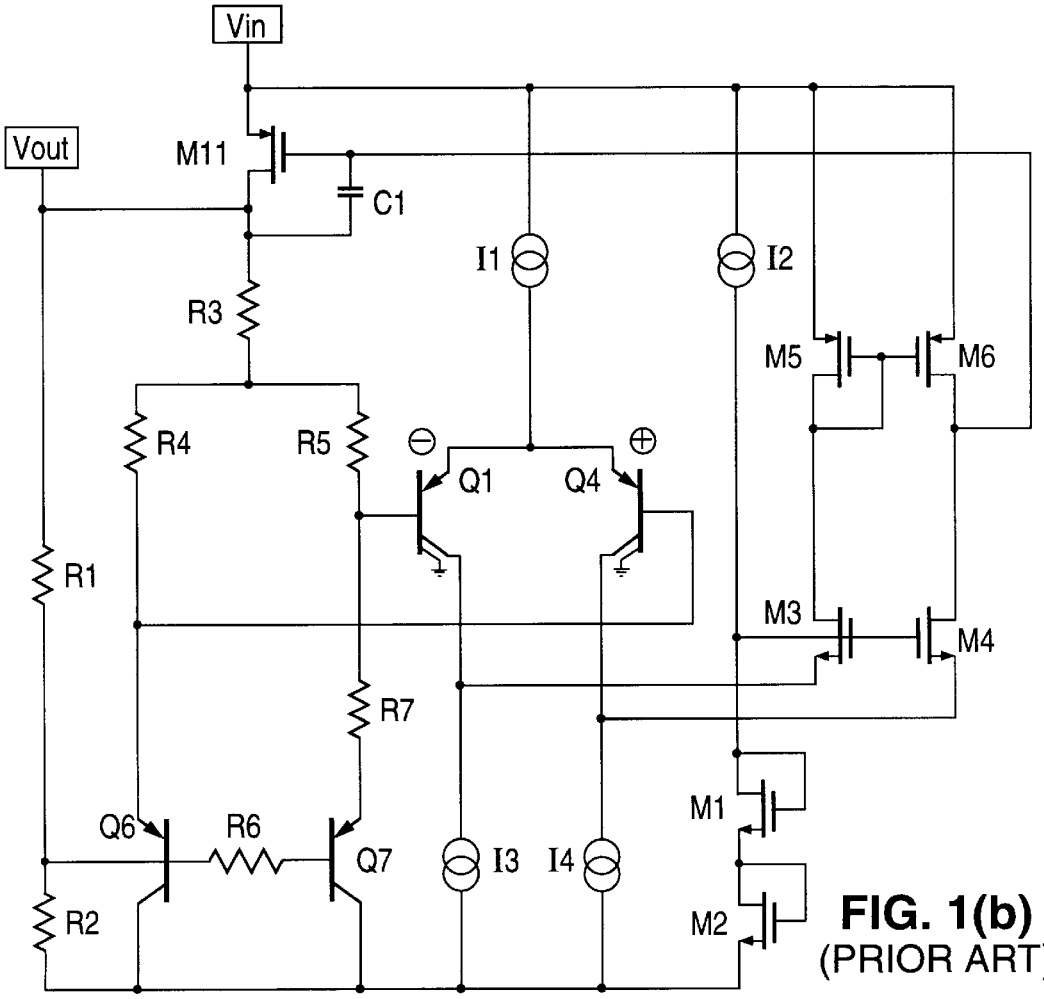
FIG. 1(b) (PRIOR ART)
FIG. 1(B) is a schematic of the of the prior art low dropout reference.

Advantageously, the present invention may be formed completely in CMOS, reducing manufacturing costs as compared to the bipolar designs in the prior art. Note that in the disclosed embodiment of FIGS. 2(A) and 2(B), the transistors of the current mirror Q3, Q4 are shown as parasitic bipolar transistors (available under standard CMOS processes), since this provides a lower dropout voltage. These transistors could also be FETs as shown in FIGS. 1(A) and 1(B).

FIG. 3 is a block diagram of a CMOS voltage reference, incorporating the present invention, having offset nullification and level, slope and curvature correction. The voltage reference comprises a band-gap core 12, connected to a primary amplifier 18 constructed according to the present invention, an output FET M11, and a null amplifier 20. The circuit further comprises a slope trim DAC 14 and a level trim DAC 16 for adjusting the slope and level of the output $V_{REF}$. A level select R4A selects one of the available output voltage options, for example, the circuit can be designed to output three different $V_{REF}$ values. Finally, the curvature trim DAC R4B is shown as a potentiometer to illustrate that it has a variable resistance, but it may actually consist of a network of non-linear resistors that can be controlled by setting a non-volatile memory. In fact, the slope, level and curvature trims can be performed after final packaging via the non-volatile memory. The CMOS voltage reference of FIG. 3 provides a precision voltage reference that can be manufactured in a standard CMOS process and trimmed after final assembly.

The primary amplifier block 18, as shown in FIG. 3, includes the circuitry of FIG. 2(B), excluding the output FET M11, and the band-gap core comprising Q6 and Q7, and the related resistors (R1–R6). These components have been reproduced separately in FIG. 3 for clarity, with the band-gap core 12 formed by Q11 and Q21. The feedback line 22 on the primary amplifier 18 corresponds to the line connecting the node formed by Q3, Q4 and C1 in FIG. 2(B), with the drain of output FET M11. The output of the primary amplifier 18 corresponds to the line connecting the drain of M6 with the gate of the output FET M11 in FIG. 2(B).

Figure 4:
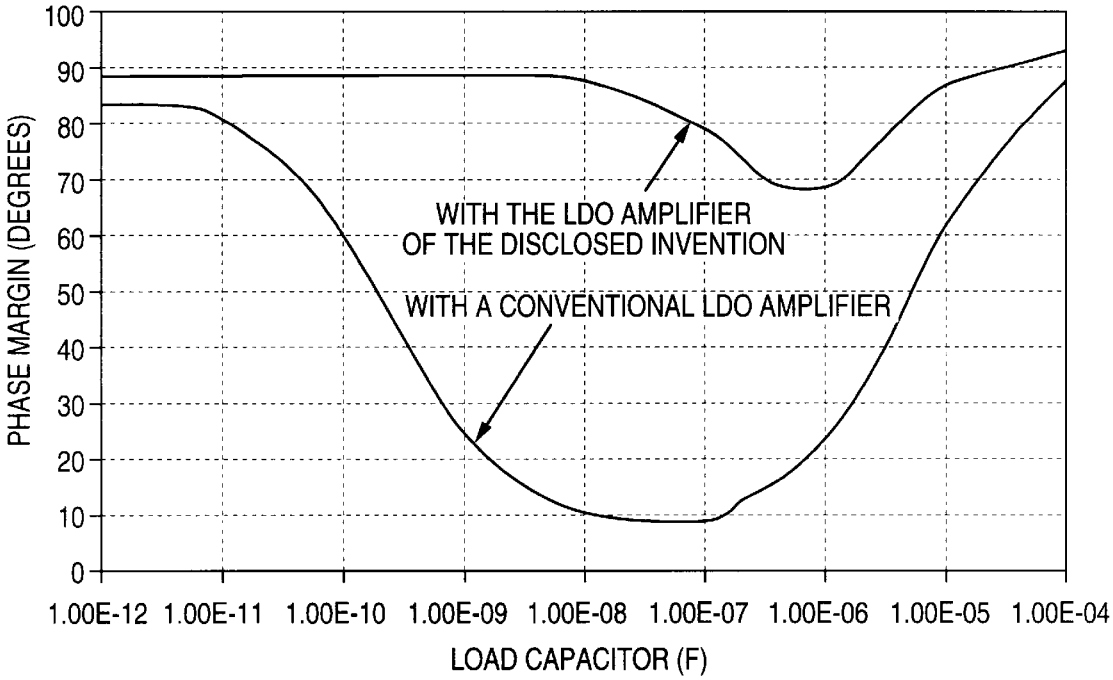
FIG. 4 is a graph of the closed loop phase margin as a function of the load capacitor, comparing the performance of a conventional low dropout amplifier and the present invention.
Figure 5:
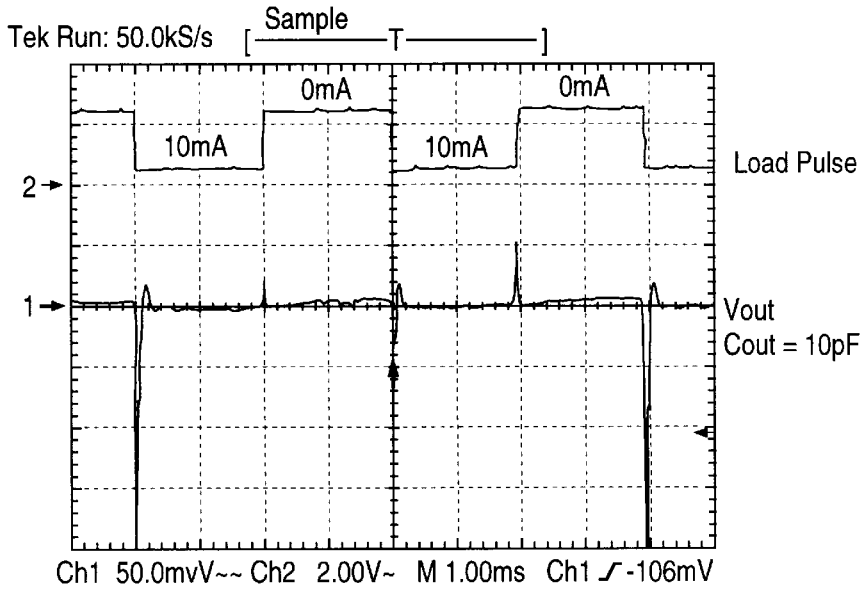
FIG. 5 is a graph showing the response of an embodiment of the present invention to a 10 mA, 1 KHz load pulse with an output capacitance of 10 pF.
Figure 6:
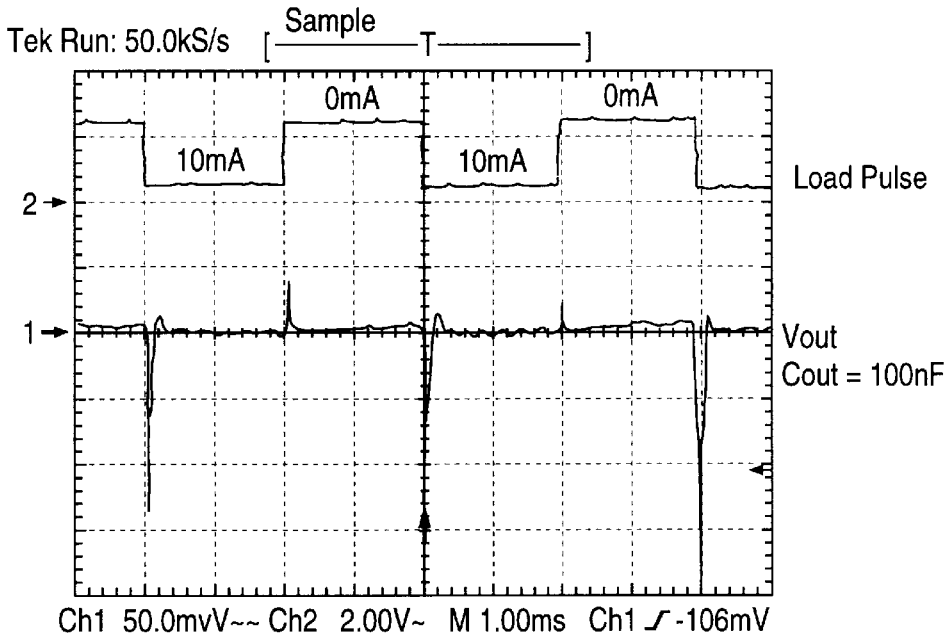
FIG. 6 is a graph showing the response of an embodiment of the present invention to a 10 mA, 1 KHz load pulse with an output capacitance of 100 nF.
Figure 7:
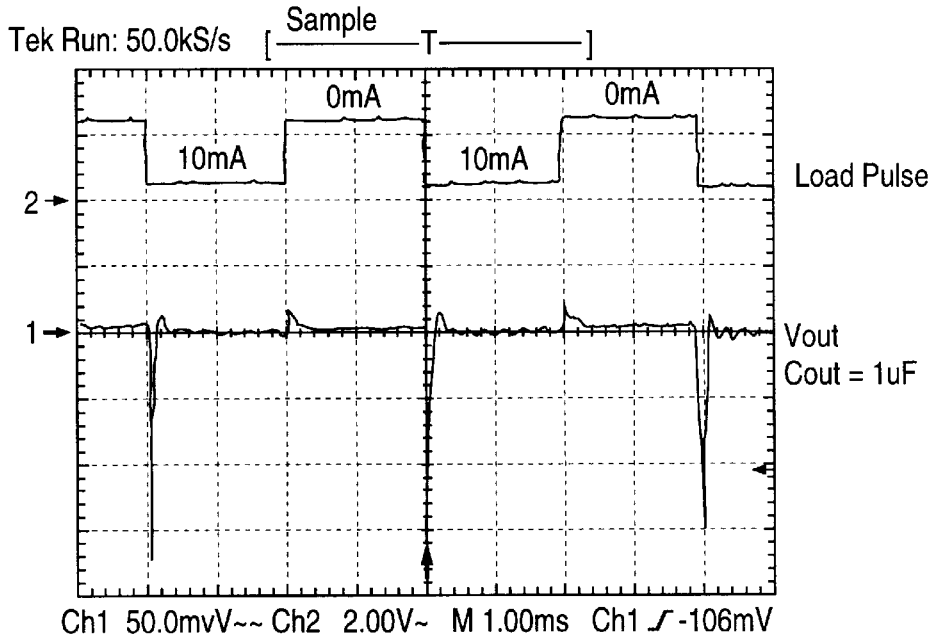
FIG. 7 is a graph showing the response of an embodiment of the present invention to a 10 mA, 1 KHz load pulse with an output capacitance of 1 $\mu$F.
Figure 8:
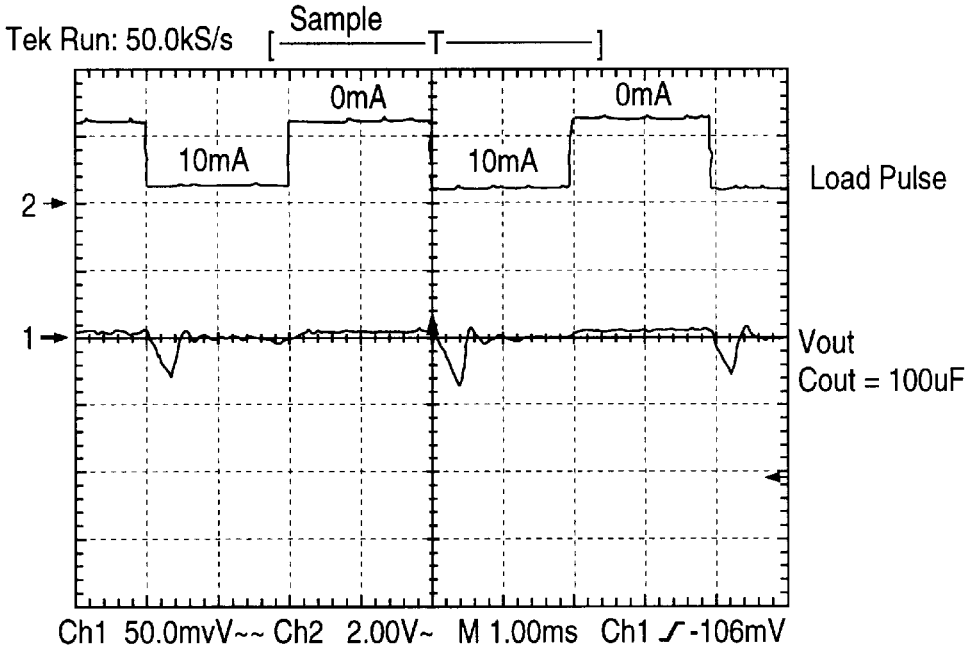
FIG. 8 is a graph showing the response of an embodiment of the present invention to a 10 mA, 1 KHz load pulse with an output capacitance of 100 $\mu$F.

FIG. 4 shows the results of computer simulations comparing the performance of the present invention (FIG. 2(A)) to a voltage reference that uses a conventional LDO amplifier as shown in FIG. 1(A). The plot compares the stability of the reference as a function of the load capacitance. The present invention maintains adequate closed loop phase margin for any practical capacitive load. It should be noted that the load capacitor used in the simulations had no equivalent series resistance.

FIGS. 5–8 show the response of a low dropout voltage reference according to the present invention to a 10 mA, 1 kHz load pulse with ceramic output capacitor values of 10 pF, 100 nF, and 100 $\mu$F, respectively. No resistors were placed in series with the load capacitors. The figures show that the reference remains stable under these varying capacitive loading conditions. A 100 nF bypass capacitor was connected to the input pin (Vin) of the reference for these tests. When the output capacitor was less or equal to 1 $\mu$F, the output setting time was typically less than 200–300 $\mu$s.

Figure 9:
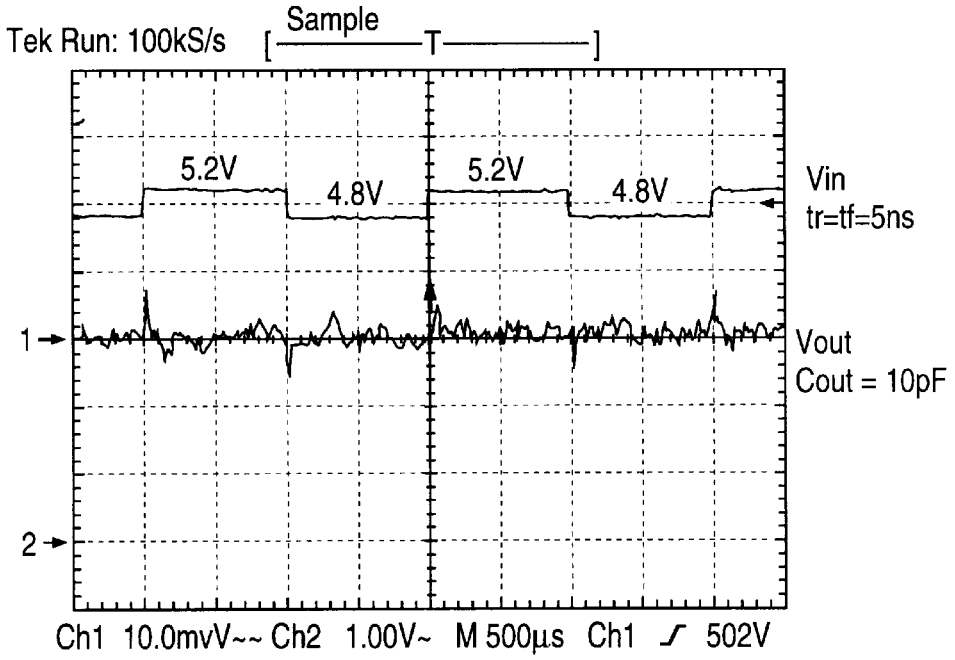
FIG. 9 is a graph showing the response of an embodiment of the present invention to a 400 mV step on the input voltage, with an output capacitance of approximately 10 pF.

FIG. 9 shows the output response of the voltage reference of the present invention to a 400 mV step on the input voltage (i.e. Vin=5V±0.2V). The rise and fall time of the step was 5 ns. The output capacitance was approximately 10 pF (due to the scope probe). The glitching seen at output due to the step on the input voltage is barely observable above the noise.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A low dropout voltage reference circuit comprising:

a voltage generator core;

a first gain stage connected to the voltage generator core;

a second gain stage connected to the first gain stage;

a third gain stage connected to the second gain stage and the voltage generator core;

a current mirror connected to the first, second and third gain stages;

an overall feedback loop comprising the first gain stage, the second gain stage, and the third gain stage; and a secondary feedback loop comprising the current mirror, the second gain stage and the third gain stage.

2. The circuit of claim 1, wherein the voltage generator core is a band-gap core circuit.

3. The circuit of claim 2, wherein the first gain stage is a differential input stage having differential inputs connected to the band-gap core circuit, and the first stage is further connected to each leg of the current mirror.

4. The circuit of claim 3, wherein the second gain stage is a differential amplifier, with a first terminal connected to a first leg of the current mirror, and a second terminal connected to a second leg of the current mirror.

5. The circuit of claim 4, wherein the second gain stage is an Output Transconductance Amplifier (OTA).

6. The circuit of claim 4, wherein the third gain stage is a p-channel output MOSFET and has a gate connected to an output of the second gain stage, a drain connected to the voltage generator core, and source connected to an input reference voltage.

7. The circuit of claim 6, wherein the current mirror connects to the drain of the output MOSFET.

8. The circuit of claim 7, wherein the current mirror comprises a pair of parasitic bipolar transistors formed in CMOS.

9. The circuit of claim 7, wherein the current mirror comprises a pair of MOSFETs.

10. The circuit of claim 8, wherein the overall feedback loop comprises an electrical loop from the drain of the output MOSFET through the differential input stage, through the differential amplifier, back to the output MOSFET.

11. The circuit of claim 10, wherein the secondary feedback loop comprises an electrical loop from the drain of the output MOSFET, through the current mirror to the differential inputs of the differential amplifier, through the differential amplifier to the gate of the output MOSFET, through the output MOSFET and back to the drain of the output MOSFET.

12. The circuit of claim 11, further comprising a first capacitance connected between the first terminal of the differential amplifier and a node, the node formed by the current mirror and the drain of the output MOSFET.

13. The circuit of claim 12, further comprising a second capacitance connected between the second terminal of the differential amplifier and a circuit ground.

14. The circuit of claim 13, wherein the first and second capacitances are equal.

15. A low dropout voltage reference circuit comprising:

a band-gap core circuit;

a differential input stage connected to the band-gap core circuit;

differential amplifier connected to the differential input stage;

an output MOSFET connected between the band-gap core circuit and an output of the differential amplifier;

a current mirror having a node, a first leg and a second leg, the mirror connected such that the node is connected to a drain of the output MOSFET, the first leg is connected to a first terminal of the differential amplifier, and the second leg is connected to a second terminal of the differential amplifier, each leg of the current mirror further connecting to the differential input stage;

an overall feedback loop comprising an electrical loop from the drain of the output MOSFET through the differential input stage, through the differential amplifier, back to the output MOSFET; and a secondary feedback loop comprising an electrical loop from the drain of the output MOSFET, through the current mirror to the differential inputs of the differential amplifier, through the differential amplifier to the gate of the output MOSFET, through the output MOSFET and back to the drain of the output MOSFET.

16. The circuit of claim 15, wherein the differential amplifier is an Output Transconductance Amplifier (OTA).

17. The circuit of claim 16, wherein output MOSFET is a p-channel output MOSFET.

18. The circuit of claim 17, wherein the current mirror comprises a pair of parasitic bipolar transistors formed in CMOS.

19. The circuit of claim 17, wherein the current mirror comprises a pair of MOSFETs.

20. The circuit of claim 18, further comprising a first capacitance connected between the first terminal of the differential amplifier and the current mirror node.

21. The circuit of claim 20, further comprising a second capacitance connected between the second terminal of the differential amplifier and a circuit ground.

22. The circuit of claim 21, wherein the first and second capacitances are equal.

23. A low dropout voltage reference comprising:

an overall feedback loop that establishes a desired output voltage, comprising:

an electrical loop from the drain of an output MOSFET through a differential input stage, through a differential amplifier, back to the output MOSFET; and a secondary feedback loop that provides a broadband reduction of the output impedance to ensure stability under various loading conditions, comprising:

an electrical loop from a drain of the output MOSFET, through the current mirror to differential inputs of a differential amplifier, through the differential amplifier to a gate of the output MOSFET, through the output MOSFET and back to the drain of the output MOSFET.

* * * * *